US009452340B2

(12) United States Patent
Vaught et al.

(10) Patent No.: US 9,452,340 B2
(45) **Date of Patent: *Sep. 27, 2016**

(54) BALL LAUNCHING DEVICE

(71) Applicant: BallFrog Sports, LLC, Bloomfield Hills, MI (US)

(72) Inventors: Kelly Andrew Vaught, Bloomfield Hills, MI (US); Christopher Gene Braniecki, Oakland Township, MI (US)

(73) Assignee: BallFrog Sports, LLC, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/754,209

(22) Filed: Jun. 29, 2015

(65) Prior Publication Data

US 2015/0297972 A1 Oct. 22, 2015

Related U.S. Application Data

(63) Continuation of application No. 14/565,870, filed on Dec. 10, 2014, now Pat. No. 9,067,119.

(60) Provisional application No. 61/915,779, filed on Dec. 13, 2013.

(51) Int. Cl.
*F41B 3/00* (2006.01)
*A63B 69/40* (2006.01)
(Continued)

(52) U.S. Cl.
CPC ..... *A63B 69/408* (2013.01); *A63B 24/00* (2013.01); *A63B 69/385* (2013.01); *F41B 3/03* (2013.01);
(Continued)

(58) Field of Classification Search
CPC .. A63B 69/385; A63B 69/40; A63B 69/407; A63B 69/408; F41B 3/03
See application file for complete search history.

(56) References Cited

U.S. PATENT DOCUMENTS 2,155,480 A 4/1939 Fazioli
2,664,077 A 12/1953 Moore
(Continued)

FOREIGN PATENT DOCUMENTS

CN 2715818 Y 8/2005
CN 201394334 Y 2/2010
(Continued)

OTHER PUBLICATIONS

Dishman 125 Auto Loading Catapult 2. YOUTube. Aug. 20, 2010. [retrieved on Feb. 12, 2015]. Retrieved from the internet: <URL: https://www.youtube.com/watch?v=JUC58PqqfH8> entire video.
(Continued)

*Primary Examiner* — John Ricci
(74) *Attorney, Agent, or Firm* — Honigman Miller Schwartz and Cohn LLP

(57) ABSTRACT

A ball launcher includes a base and a thrower arm defining a ball cradle. An arm holder is disposed on the base and pivotally supports the thrower arm about a first axis of rotation, the thrower arm spring biased about the first axis of rotation. A rotating shaft defines a second axis of rotation substantially parallel to the fore-aft axis. A ball loader is coupled to the rotating shaft for common rotation about the second axis of rotation, the ball loader defining a ball receptacle. A loader arm is releasably connected to the rotating shaft for common rotation about the second axis of rotation. The loader arm defines a longitudinal axis substantially perpendicular to the second axis of rotation of the rotating shaft and has a length extending away from the rotating shaft.

24 Claims, 10 Drawing Sheets

(51) Int. Cl.

| | |
|---|---|
| ***A63B 69/38*** | (2006.01) |
| ***F41B 3/03*** | (2006.01) |
| ***A63B 24/00*** | (2006.01) |
| ***F41B 3/04*** | (2006.01) |
| *A63B 71/06* | (2006.01) |
| *A63B 47/00* | (2006.01) |
| *A63B 69/00* | (2006.01) |

(52) U.S. Cl.

CPC ..... *F41B 3/04* (2013.01); *A63B 47/002* (2013.01); *A63B 69/38* (2013.01); *A63B 71/0622* (2013.01); *A63B 2069/0008* (2013.01); *A63B 2071/0625* (2013.01); *A63B 2207/02* (2013.01); *A63B 2208/0204* (2013.01); *A63B 2225/09* (2013.01); *A63B 2225/093* (2013.01); *A63B 2225/50* (2013.01); *A63B 2243/0083* (2013.01)

(56) References Cited

U.S. PATENT DOCUMENTS

| | | | | |
|---|---|---|---|---|
| 2,696,204 | A * | 12/1954 | Gilgoff | A63B 69/408 124/41.1 |
| 2,705,003 | A | 3/1955 | Schensted | |
| 3,080,859 | A | 3/1963 | Benkoe | |
| 3,368,541 | A | 2/1968 | Brink | |
| 3,446,199 | A | 5/1969 | Saveca | |
| 3,470,859 | A | 10/1969 | Ponza | |
| 3,545,752 | A | 12/1970 | Hill et al. | |
| 3,612,027 | A | 10/1971 | Makino | |
| 3,627,319 | A | 12/1971 | Van Skyhawk | |
| 3,770,272 | A | 11/1973 | Olivier | |
| 3,841,294 | A | 10/1974 | McGill | |
| 3,856,300 | A | 12/1974 | Payne | |
| 3,911,888 | A | 10/1975 | Horvath | |
| 4,025,071 | A | 5/1977 | Hodges | |
| 4,129,110 | A | 12/1978 | Kubrak | |
| 4,164,928 | A | 8/1979 | Meares | |
| 4,203,413 | A | 5/1980 | Hodges | |
| 4,207,857 | A | 6/1980 | Balka, Jr. | |
| 4,209,004 | A * | 6/1980 | Kennedy | A63B 69/408 124/16 |
| 4,282,848 | A | 8/1981 | Kulesza et al. | |
| 4,291,665 | A | 9/1981 | Bash et al. | |
| 4,372,283 | A | 2/1983 | Balka, Jr. | |
| 4,402,507 | A | 9/1983 | Hudson | |
| 4,552,120 | A | 11/1985 | Nall et al. | |
| 4,564,195 | A | 1/1986 | McClure et al. | |
| 4,575,080 | A | 3/1986 | Miles | |
| 4,778,177 | A | 10/1988 | Taksony | |
| 4,841,945 | A | 6/1989 | Braden | |
| 4,858,921 | A | 8/1989 | Eustice et al. | |
| 4,865,318 | A | 9/1989 | Lehmann et al. | |
| 4,946,164 | A | 8/1990 | Fuller et al. | |
| 4,995,371 | A | 2/1991 | Kuizinas | |
| 5,011,144 | A | 4/1991 | Marello et al. | |
| 5,145,176 | A | 9/1992 | Lipson | |
| 5,160,131 | A | 11/1992 | Leon | |
| 5,178,123 | A | 1/1993 | Yeh | |
| 5,207,421 | A | 5/1993 | Gorvin | |
| 5,221,081 | A | 6/1993 | Rooks | |
| 5,294,109 | A | 3/1994 | Meade | |
| 5,485,994 | A | 1/1996 | Underwood et al. | |
| 5,575,482 | A | 11/1996 | Butler, Jr. | |
| 5,590,876 | A | 1/1997 | Sejnowski | |
| 5,597,160 | A | 1/1997 | Mims | |
| 5,613,678 | A | 3/1997 | McKee et al. | |
| 5,619,977 | A * | 4/1997 | Gatin | A63B 69/408 124/16 |
| 5,672,124 | A | 9/1997 | Pecoraro et al. | |
| 5,733,209 | A | 3/1998 | McIntyre, IV | |
| 5,746,670 | A | 5/1998 | Brady | |
| 5,800,288 | A | 9/1998 | Mims | |
| 6,019,096 | A | 2/2000 | Snyder et al. | |
| 6,089,215 | A | 7/2000 | Morris et al. | |
| 6,099,417 | A | 8/2000 | Brown et al. | |
| 6,167,878 | B1 | 1/2001 | Nickerson et al. | |
| 6,416,429 | B1 | 7/2002 | Pecoraro et al. | |
| 6,443,859 | B1 | 9/2002 | Markin | |
| 6,684,872 | B2 | 2/2004 | Kao et al. | |
| 6,719,649 | B1 | 4/2004 | Lin | |
| 6,875,136 | B2 | 4/2005 | Leal et al. | |
| 6,916,256 | B1 | 7/2005 | Buster et al. | |
| 6,926,623 | B2 | 8/2005 | Lin | |
| 7,028,682 | B1 | 4/2006 | Hansen | |
| 7,100,594 | B2 | 9/2006 | Boehner | |
| 7,278,934 | B2 | 10/2007 | McBride et al. | |
| 7,294,071 | B1 | 11/2007 | Saumell | |
| 7,458,907 | B2 | 12/2008 | Wang | |
| 7,722,485 | B2 | 5/2010 | Balasubramanyan | |
| 7,846,045 | B1 | 12/2010 | Kendall | |
| 7,861,699 | B2 | 1/2011 | Gowan et al. | |
| 7,874,942 | B2 | 1/2011 | Auzoux et al. | |
| 7,958,880 | B1 | 6/2011 | Mashburn | |
| 8,042,531 | B2 | 10/2011 | Mashburn | |
| 8,151,782 | B2 | 4/2012 | Huang | |
| 9,067,119 | B1 * | 6/2015 | Vaught | F41B 3/03 |
| 2002/0104525 | A1 | 8/2002 | Boehner | |
| 2003/0069092 | A1 | 4/2003 | Gowan et al. | |
| 2003/0203773 | A1 | 10/2003 | Leal et al. | |
| 2004/0038756 | A1 | 2/2004 | Brophy | |
| 2004/0266562 | A1 | 12/2004 | Gowan et al. | |
| 2007/0010353 | A1 | 1/2007 | Huang | |
| 2008/0096697 | A1 | 4/2008 | Balasubramanyan | |
| 2008/0096698 | A1 | 4/2008 | Balasubramanyan | |
| 2010/0099520 | A1 | 4/2010 | Auzoux et al. | |
| 2011/0073091 | A1 | 3/2011 | Gowan et al. | |
| 2011/0094487 | A1 | 4/2011 | Woyton | |
| 2011/0152011 | A1 | 6/2011 | Forrest | |
| 2011/0192384 | A1 | 8/2011 | Huang | |
| 2011/0275459 | A1 | 11/2011 | Polich | |

FOREIGN PATENT DOCUMENTS

| | | | |
|---|---|---|---|
| CN | 201799083 | U | 4/2011 |
| CN | 102145223 | A | 8/2011 |
| CN | 201930500 | U | 8/2011 |
| CN | 202315226 | U | 7/2012 |
| CN | 102614642 | A | 8/2012 |
| CN | 202554880 | U | 11/2012 |
| CN | 202569414 | U | 12/2012 |
| DE | 3432618 | A1 | 6/1985 |
| DE | 3815091 | A1 | 11/1989 |
| GB | 315851 | A | 8/1930 |
| JP | 2000084134 | A | 3/2000 |
| WO | WO-8801188 | A1 | 2/1988 |
| WO | WO-8910775 | A1 | 11/1989 |
| WO | WO-2010019994 | A1 | 2/2010 |

OTHER PUBLICATIONS

Diercksfamily. Davis Fully Automatic Lego Catapult. YouTube. Jul. 26, 2010. [retrieved on Feb. 12, 2015]. Retrieved from the internet: <URL: https://www.youtube.com/watch?v=C6KdUsX287A> entire video.

Bluescreenerror. Auto Reloading Robotic Catapult. YouTube. May 11, 2009. [retrieved on Feb. 12, 2015]. Retrieved from the internet: <URL: https://www.youtube.com/watch?v=hAwaxG5hk6U> entire video.

International Search Report for application PCT/US2014/069470 dated Mar. 10, 2015.

* cited by examiner

BALL LAUNCHING DEVICE

CROSS REFERENCE TO RELATED APPLICATIONS

This U.S. patent application is a Continuation Application of U.S. patent application Ser. No. 14/565,870 filed on Dec. 10, 2014 (now U.S. Pat. No. 9,067,119 issued on Jun. 30, 2015), which claims priority under 35 U.S.C. §119(e) to U.S. Provisional Application Ser. No. 61/915,779, filed on Dec. 13, 2013, which are hereby incorporated by reference in their entirety.

TECHNICAL FIELD

This disclosure relates to a ball throwing device that launches a ball.

BACKGROUND

Several sports, such as tennis, baseball, softball, volleyball, among others, require a player to hit a ball either with a racquet, a bat, or their hand. Players often practice hitting the ball. Generally, two players are necessary to practice these sports. One player throws the ball, and another player catches the ball or hits the ball back to the first player. Sometimes, a player wants to practice hitting a ball and does not have another player to throw the ball. Therefore, if a player wants to improve his or her ball hitting skills, a player needs the assistance of another player and cannot play by himself or herself. Moreover, the other player might not be skilled in the game and might lack the techniques of throwing the ball correctly.

Tennis is usually an individual sport where two teams play against each other. Each team may include a single player (singles) or two players (doubles). The object of the game is for each player to play the ball in such a way that the opponent is not able to play a good return. Each player has a racquet strung with cord to strike a ball thrown by the opponent. The ball is usually a hollow rubber ball covered with felt. Each player stands on one side of a net that divides a court, and the ball is thrown between the players over the net. In tennis, the serve is generally the most challenging part of the game. The tennis serve consists of a player throwing the ball in the air and swinging the racquet toward the opponent on the other side of the court.

SUMMARY

One aspect of the disclosure provides a ball launcher including a base, a thrower arm, a ball loader, and a loader arm. The thrower arm is pivotally supported by the base and has a first end and a second end. The first end defines a ball cradle. The thrower arm is spring biased in a pivoting direction. The ball loader is rotatably supported by the base and defines an axis of rotation and a ball receptacle. The loader arm is rotatably supported about the axis of rotation and extends away from the axis of rotation. The ball loader and the loader arm are arranged so that as the ball loader rotates, the ball receptacle releases a received ball into the ball cradle, and the loader arm engages and moves the thrower arm between a released state and an engaged state.

Implementations of the disclosure may include one or more of the following optional features. In some implementations, the ball loader releases a received ball from the ball receptacle into the ball cradle before the loader arm engages the thrower arm. The ball loader may release a received ball from the ball receptacle into the ball cradle after the loader arm engages the thrower arm and before the loader arm moves the thrower arm from its engaged state to its released state. The loader arm may extend perpendicular to the axis of the rotation of the ball loader. Additionally or alternatively, the loader arm may have a variable length or width.

In some examples, the ball launcher includes a shaft rotatably supported by the base and a motor coupled to the shaft. The ball loader is disposed on the shaft. The ball launcher may also include a thrower stop arranged to limit pivotal movement of the thrower arm to set a ball release position of the thrower arm. Additionally or alternatively, the thrower arm may be pivotally supported between its first and second ends. The thrower stop may be arranged to receive the second end of the thrower arm. In some examples, the ball launcher includes one or more legs supporting the base. Each leg has an adjustable length to tilt the base with respect to a supporting surface.

Another aspect of the disclosure provides a method of launching a ball. The method includes loading a ball into a ball receptacle defined by a ball loader rotatably supported about an axis of rotation and rotating the ball loader about the axis of rotation. As the ball loader rotates, the ball receptacle releases the received ball from the ball receptacle into a ball cradle defined by a pivotally supported, spring biased thrower arm. A loader arm is disposed on the ball loader and extending away from the axis of rotation engages the thrower arm, moving the thrower arm between a released state and an engaged state.

In some implementations, the ball receptacle releases the received ball into the cradle before the loader arm engages the thrower arm. The method may include the ball receptacle releasing the received ball from the ball receptacle into the ball cradle after the loader arm engages the thrower arm and before the loader arm moves the thrower arm from its engaged state to its released state.

In some examples, the loader arm extends perpendicular to the axis of rotation. Additionally or alternatively, the method may include adjusting a length of the loader arm to alter an angular pivot range of the thrower arm while engaged by the loader arm. The method may further include adjusting a position of the loader arm along the axis of rotation to alter an angular pivot range of the thrower arm while engaged by the loader arm.

In some implementations, the method includes limiting pivotal movement of the thrower arm to set a ball release position of the thrower arm. Additionally or alternatively, the method may further include adjusting a thrower stop. The thrower stop is arranged to limit pivotal movement of one end of the thrower arm. The thrower arm has first and second ends and is pivotally supported between its first and second ends.

Yet another aspect of the disclosure provides a method of launching a ball. The method includes receiving a ball in a ball receptacle defined by a ball loader, rotating the ball loader about an axis of rotation, and releasing the received ball from the ball receptacle into a ball cradle disposed on a pivotally supported spring biased thrower arm. The method also includes rotating a loader arm about the axis of rotation, engaging the loader arm with the thrower arm. The loader arm moves the thrower arm between a released state and an engaged state.

In some examples, the method further includes releasing the received ball from the ball receptacle into the ball cradle before the loader arm engages the thrower arm. The method may also include releasing the received ball from the ball receptacle into the ball cradle after the loader arm engages the thrower arm and before the loader arm moves the thrower arm from its engaged state to its released state.

The loader arm may extend perpendicular to the axis of rotation. Additionally or alternatively, the method may include adjusting a length of the loader arm to alter an angular pivot range of the thrower arm while engaged by the loader arm.

The method may also include adjusting a position of the loader arm along the axis of rotation to alter an angular pivot range of the thrower arm while engaged by the loader arm. The method may include limiting pivotal movement of the thrower arm to set a ball release position of the thrower arm. Additionally or alternatively, the method may include adjusting a thrower stop arranged to limit pivotal movement of one end of the thrower arm. The thrower arm has first and second ends and is pivotally supported between its first and second ends.

Another aspect of the disclosure provides a ball launcher including a base defining a transverse axis, a fore-aft axis, and a central vertical axis, wherein the transverse axis and the fore-aft axis form an X-Y plane substantially parallel to a supporting surface. The ball launcher further includes a thrower arm having a first end and a second end the first end defining a ball cradle. An arm holder is disposed on the base and pivotally supports the second end of the thrower arm about a first axis of rotation substantially parallel to the transverse axis, the thrower arm spring biased about the first axis of rotation between a ball receiving or releasing position and an engaged position. A rotating shaft defines a second axis of rotation and has a front end and a back end. The second axis of rotation is substantially parallel to the fore-aft axis. A ball loader is coupled to the front end of the rotating shaft for common rotation about the second axis of rotation, the ball loader defining a ball receptacle sized and shaped to receive and releasably support a ball. The ball launcher further includes a loader arm releasably connected to the rotating shaft for common rotation about the second axis of rotation when the rotating shaft rotates, the loader arm defining a longitudinal axis substantially perpendicular to the second axis of rotation of the shaft and having a length extending away from the rotating shaft. The rotating shaft, the ball loader and the loader arm are arranged so that as the rotating shaft rotates about the second axis of rotation: the ball loader rotates in unison about the second axis of rotation to release a received ball from the ball receptacle into the ball cradle while the thrower arm is in the ball receiving position; and the loader arm rotates in unison about the second axis of rotation to engage and move the thrower arm from the ball receiving position to the engaged position when the loader arm contacts a contact surface associated with the thrower arm.

In some implementations, the ball receptacle releases the received ball into the cradle before the loader arm engages the thrower arm. In some examples, the ball loader releases a received ball from the ball receptacle into the ball cradle after the loader arm engages the thrower arm and before the loader arm moves the thrower arm from its ball receiving position to its engaged position. The loader arm may have a variable length and/or a variable position about the rotating shaft along the second axis of rotation.

In some examples, the contact surface associated with the thrower arm includes a top surface of the thrower arm. The contract surface associated with the thrower arm may be supported by an engagement member disposed on the thrower arm. In some examples, the contact surface includes a roller rotatably supported by the engagement member. The contact surface may be angled with respect to the longitudinal axis of the thrower arm. In some examples, the engagement member has a variable position about the thrower arm along the longitudinal axis of the thrower arm. In some implementations, a contact point between the loader arm and the contact surface has a variable height from the thrower arm with respect to the center vertical axis of the base based upon a position of the engagement member about the thrower arm along the longitudinal axis of the thrower arm and a position of the loader arm about the rotating shaft along the second axis of rotation.

In some examples, the ball launcher includes a motor coupled to the back end of the rotating shaft for common rotation about the second axis of rotation when the motor rotates. A thrower stop may be arranged to limit pivotal movement of the thrower arm to set the ball receiving or releasing position of the thrower arm. In some implementations, a spring support is disposed on the second end of the thrower arm, the thrower stop is disposed between the spring support and the base, and one or more springs connect the spring support to one of the thrower stop or the base. The springs bias the thrower arm in the ball receiving or releasing position when the loader arm and the thrower arm are disengaged and the ball cradle is unoccupied. The thrower stop may telescope between a retracted position and an expanded position to set the ball receiving or releasing position of the thrower arm. The ball launcher may further include one or more legs supporting the base, each leg having an adjustable length to tilt the base with respect to the supporting surface.

Yet another aspect of the disclosure provides a method of launching a ball. The method includes setting a ball receiving or releasing position of a thrower arm pivotally supported by an arm holder about a first axis of rotation. The thrower arm is spring biased about the first axis of rotation between the ball receiving or releasing position and an engaged position. The method also includes loading a ball into a ball receptacle defined by a ball loader coupled to a rotating shaft for common rotation about a second axis of rotation defined by the rotating shaft when the rotating shaft rotates. The second axis of rotation is substantially perpendicular to the first axis of rotation. The method also includes rotating the ball loader and the rotating shaft in unison about the second axis of rotation. As the ball loader rotates, the ball receptacle releases the received ball from the ball receptacle into a ball cradle connected to the thrower arm and a loader arm moves the thrower arm from the ball receiving position to the engaged position when the loader arm contacts a contact surface associated with the thrower arm. The loader arm is releasably connected to the rotating shaft for common rotation about the second axis of rotation when the rotating shaft rotates and defining a longitudinal axis substantially perpendicular to the second axis of rotation of the rotating shaft.

In some implementations, the ball receptacle releases the received ball into the cradle before the loader arm engages the thrower arm. In other implementations, the ball receptacle releases the received ball from the ball receptacle into the ball cradle after the loader arm engages the thrower arm and before the loader arm moves the thrower arm from its ball receiving position to its engaged position.

In some examples, the method also includes adjusting a position of the loader arm about the rotating shaft along the second axis of rotation to alter an angular pivot range of the thrower arm while engaged by the loader arm. The method may also include limiting pivotal movement of the thrower arm to set the ball receiving or releasing position of the thrower arm. In some examples, the method also includes adjusting a thrower stop arranged to limit pivotal movement of the thrower arm, the thrower arm having a first end connected to the ball cradle and a second end rotatably supported by the arm holder about the first axis of rotation. In some implementations, the method also includes connecting one or more springs between a spring support disposed on the second end of the thrower arm and one of the thrower stop or the base, the springs biasing the thrower arm in the ball receiving or releasing position when the loader arm and the thrower arm are disengaged and the ball cradle is unoccupied.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
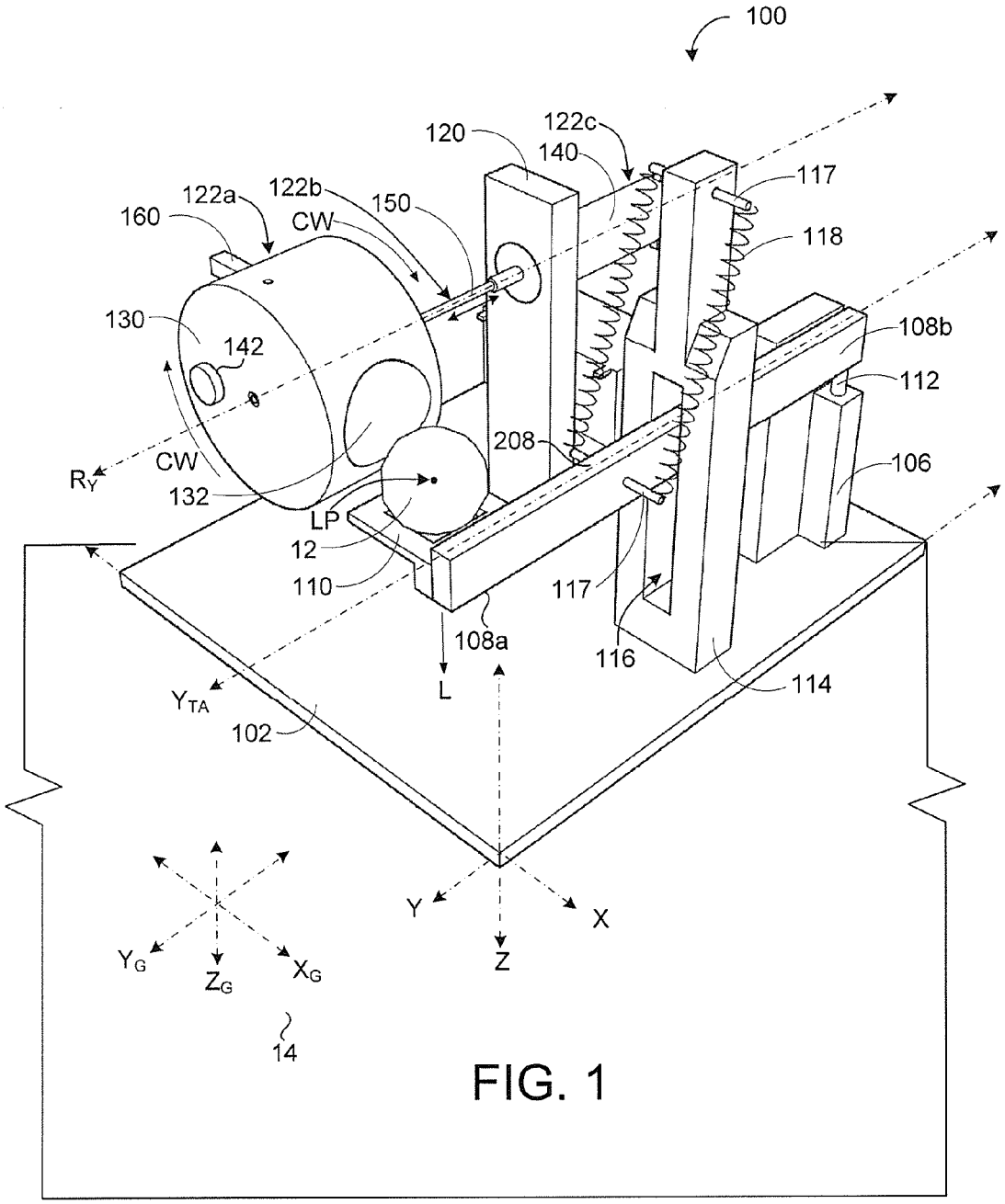
FIGS. 1 and 2 are schematic views of an exemplary ball launching device.

In games that entail hitting a ball, players usually struggle with tossing the ball to a desired location before hitting the ball. For example, tennis players may struggle with tossing a ball to a desired location above their head before hitting the ball at a desired height. In some instances, it is desirable for a player to practice tossing the ball separately from hitting the ball. This allows the player to develop muscle memory and confidence in one aspect of the serve separately from another aspect of the serve.

Referring to FIGS. 1-6, a ball launcher 100 helps players 10 practice hitting a ball 12 tossed in a consistent manner. For example, the ball launcher 100 can help a player 10 practice hitting a tossed tennis ball 12 during a serve by isolating two aspects of the serve (tossing and hitting). Although the examples herein are described with reference to practicing hitting a tennis ball with a racquet, the ball launcher 100 may be used and configured for any type of sport that includes hitting or striking a ball (e.g., baseball, softball, volleyball, etc.). The ball launcher 100 is a lightweight and portable device capable of being carried around by a user 10 (e.g., trainer or a player) when practicing. The ball launcher 100 allows a player 10 to practice several of his/her tennis shots, including but not limited to serving, forehand, backhand, volley, slice, smash (overhead), and lob.

The ball launcher 100 includes a base 102, which may be disposed on one or more legs 104. The base 102 defines a transverse axis X, a fore-aft axis Y, and a central vertical axis Z. The transverse axis X and the fort-aft axis Y form an X-Y plane substantially parallel to a ground $X_G$-$Y_G$ plane of the ground surface 14 when the legs 104 are each at an equal distance $D_L$ from the ground surface 14. In some examples, the legs 104 are adjustable, allowing a user 10 to adjust the distance $D_L$ of each leg 104 from the ground surface 14. In such examples, the base plane, i.e., X-Y plane, and the ground $X_G$-$Y_G$ plane intersect. The user 10 may decide to adjust one or more legs 104 resulting in an uneven base 102 with respect to the ground plane $X_G$-$Y_G$ plane. Adjusting a tilt of the base 102 by adjusting the distance $D_L$ of the legs 104 from the ground surface 14 is one of the ways to adjust a launch point LP of a ball 12 from a ball cradle 110 with respect to the base 102 or the ground surface 14.

Figure 2:
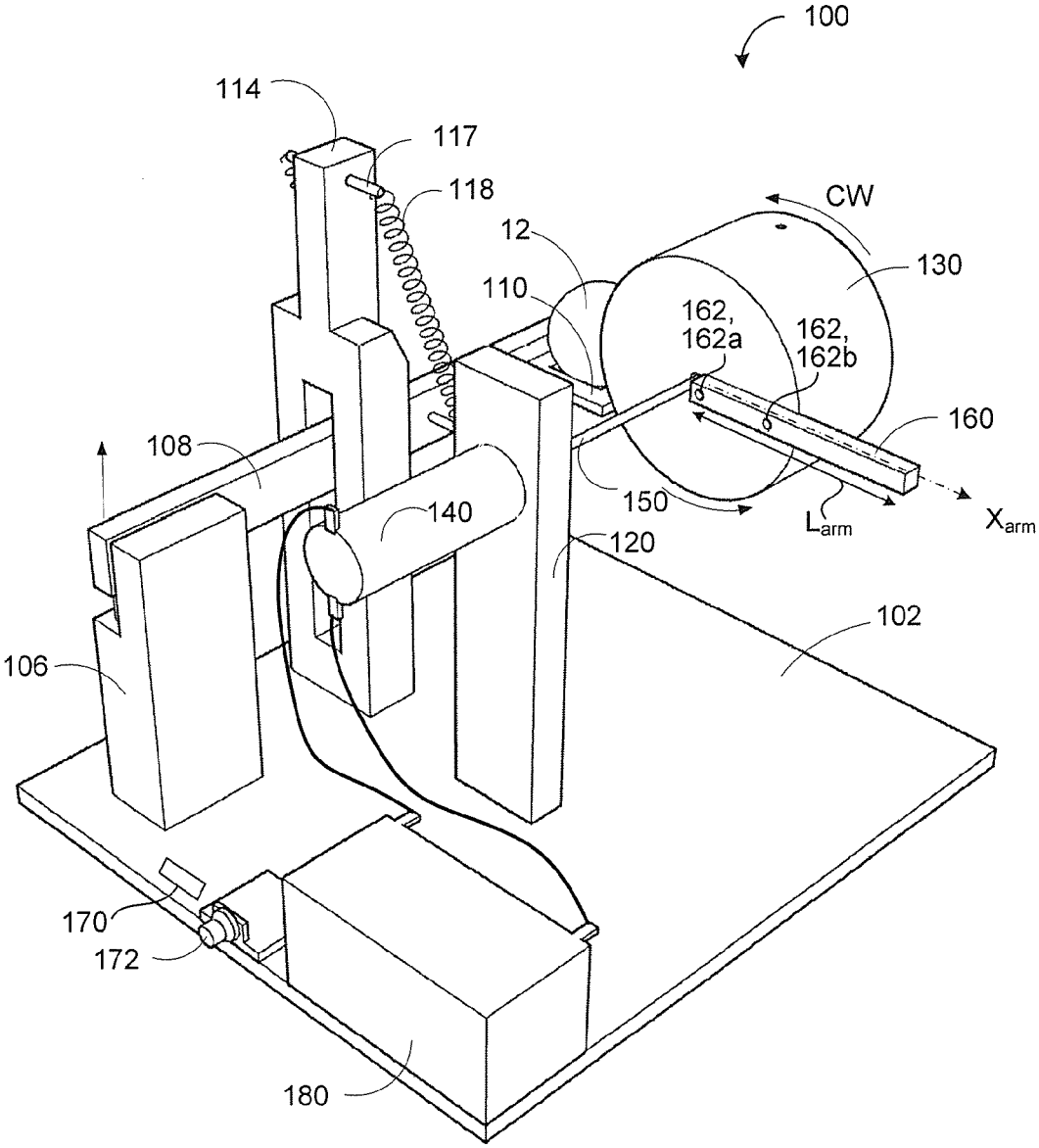
Figure 3:
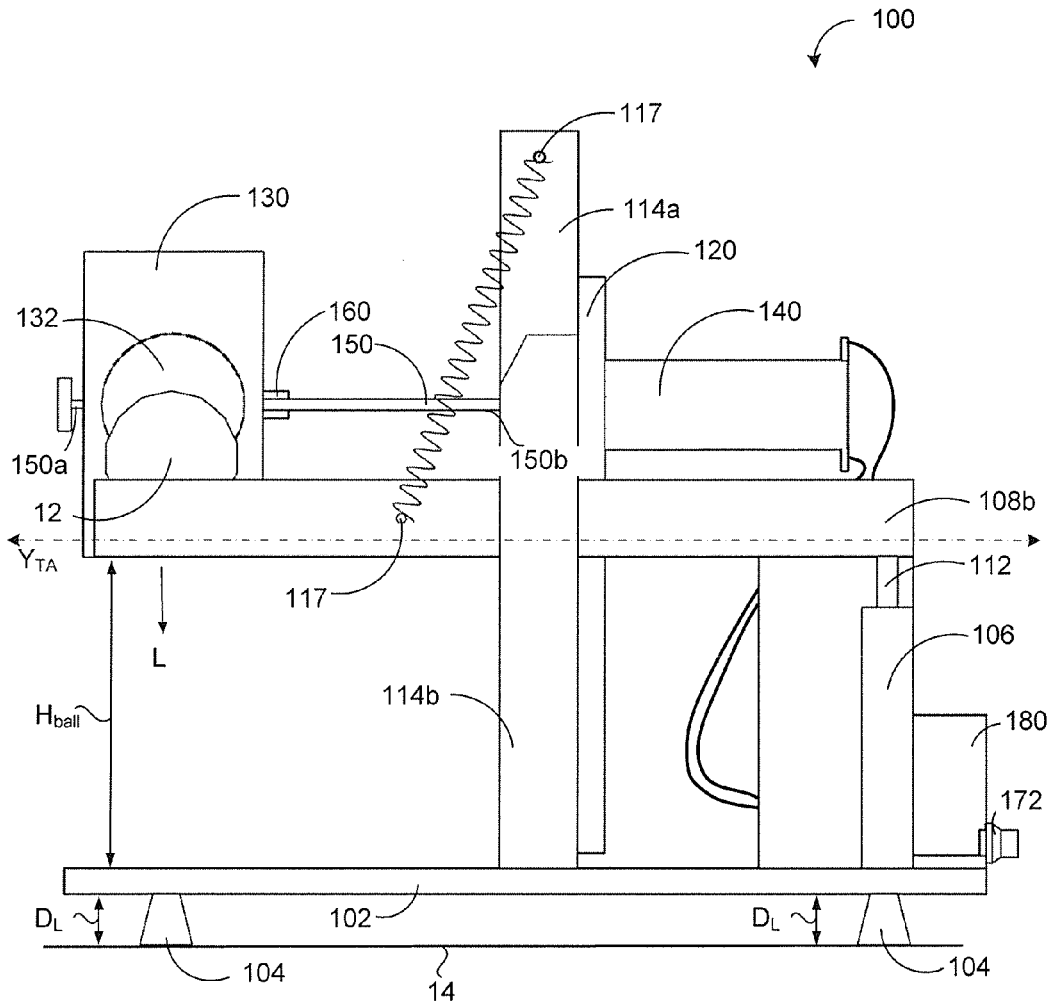
FIG. 3 is a schematic side view of an exemplary ball launching device.
Figure 4:
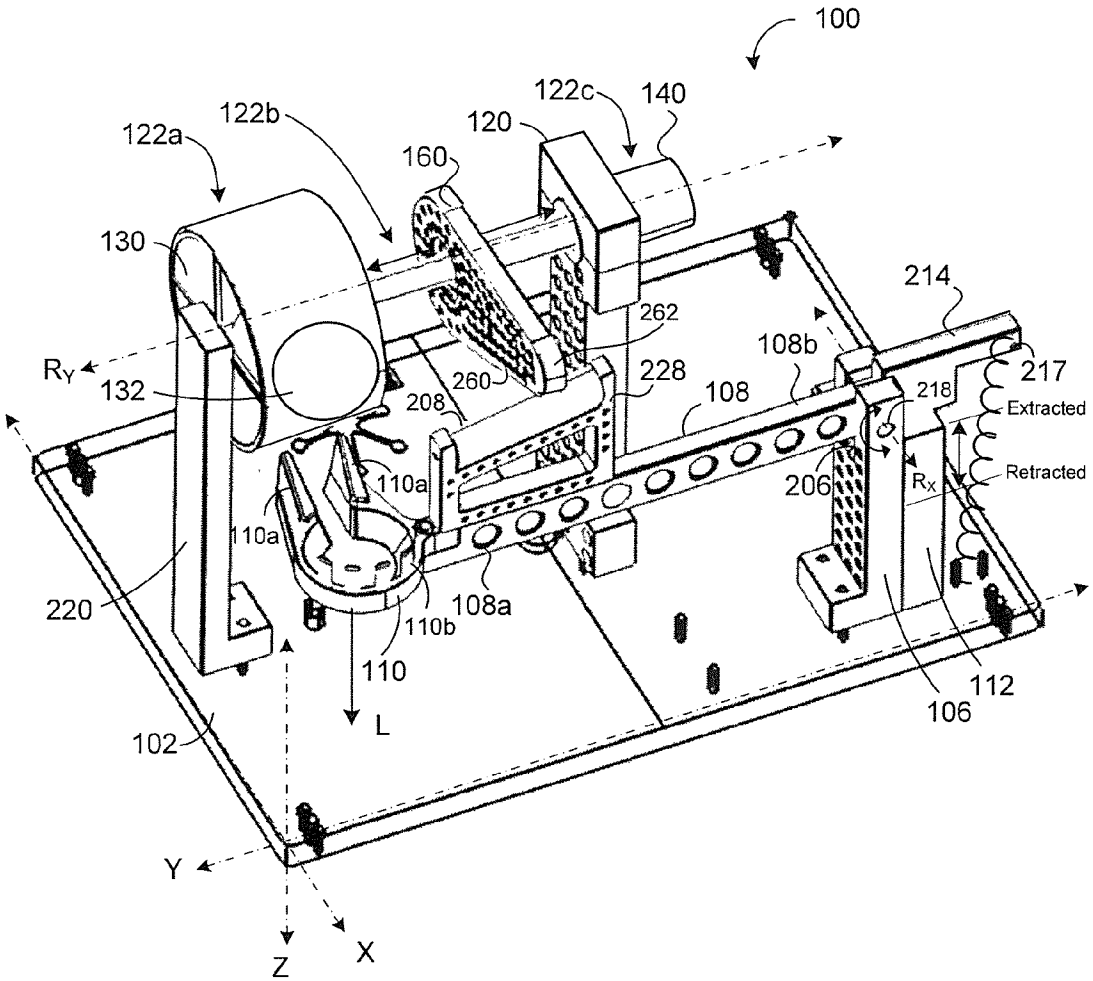
FIGS. 4 and 5 are schematic views of an exemplary ball launching device.
Figure 5:
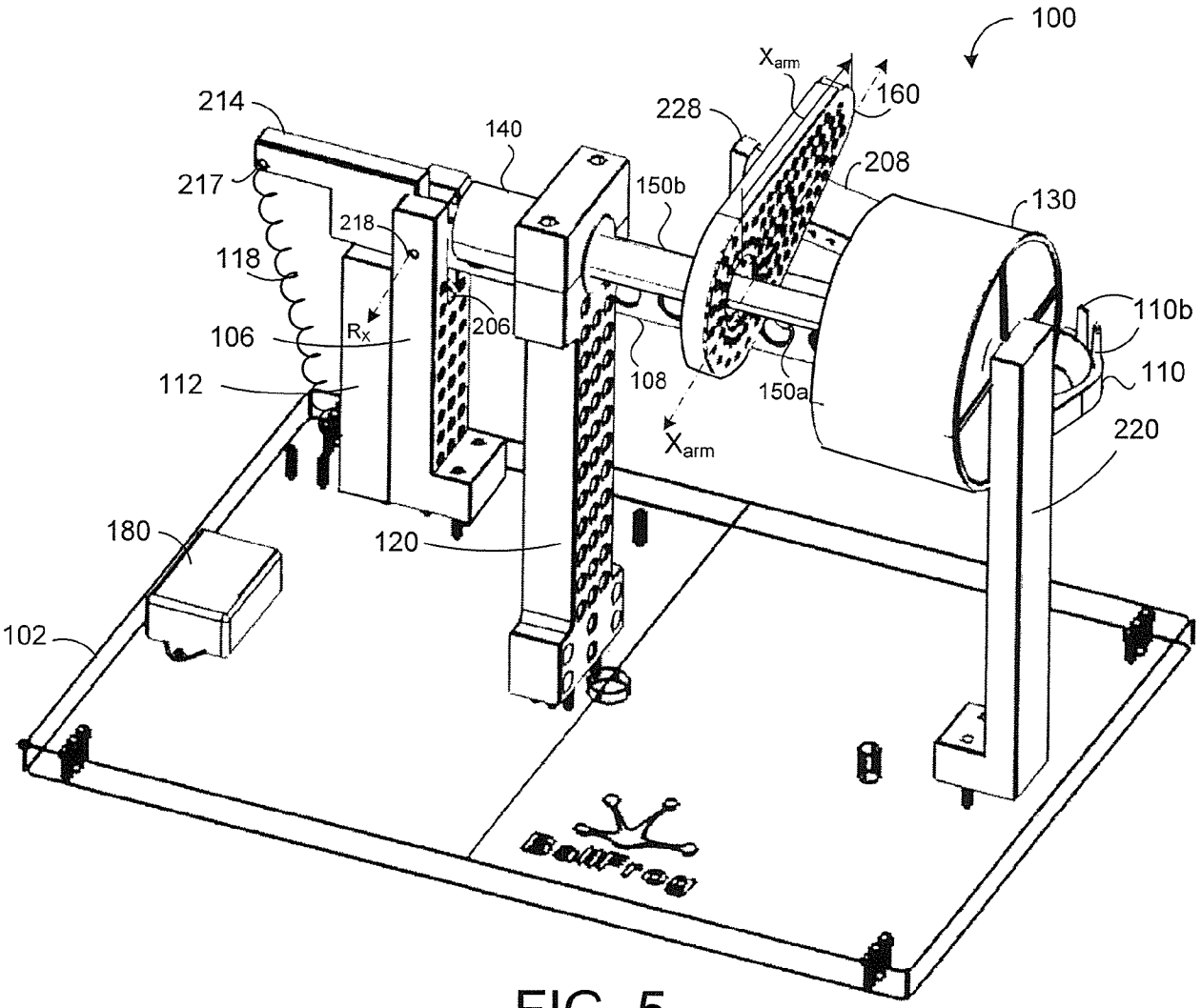
Figure 6:
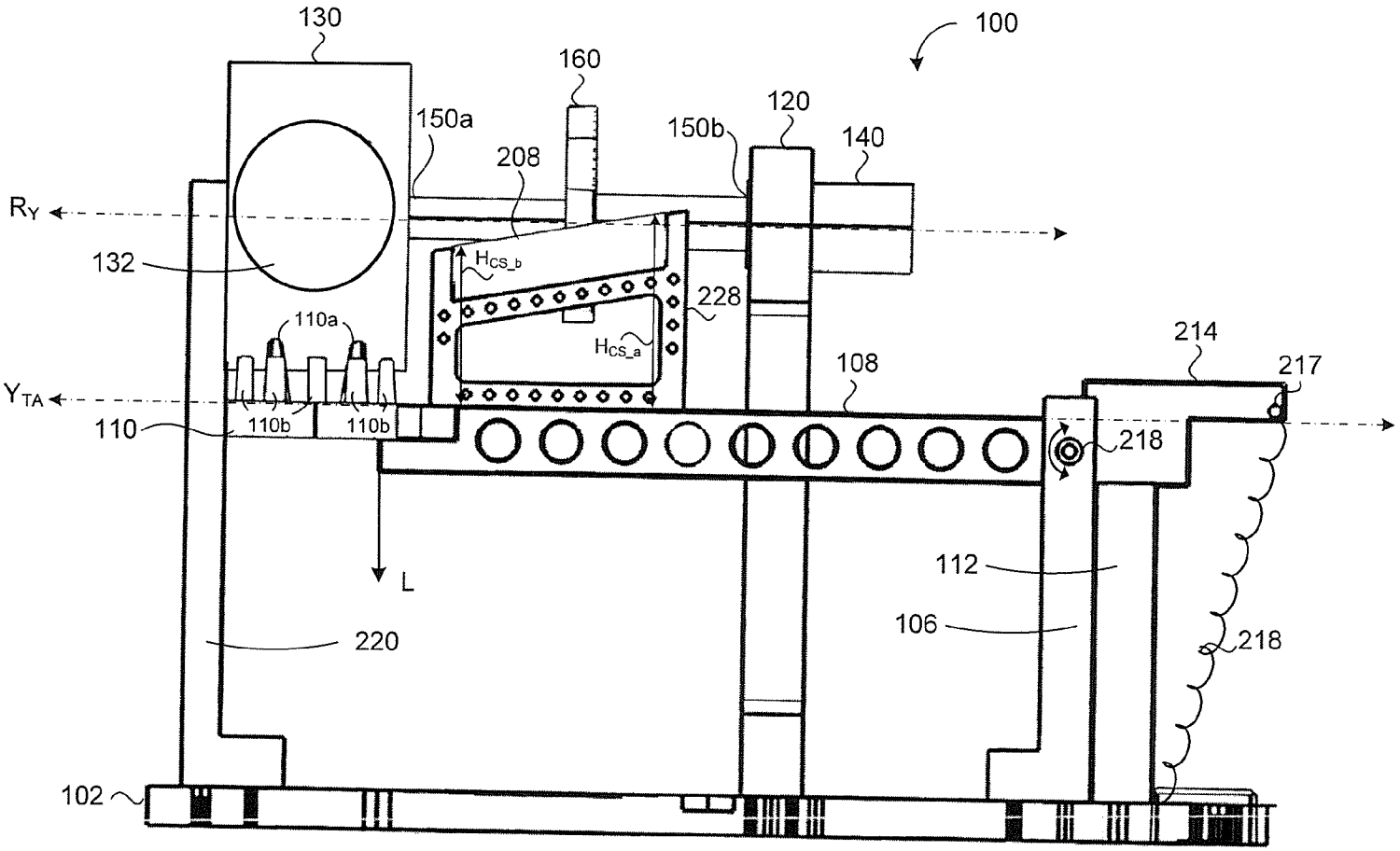
FIG. 6 is a schematic side view of an exemplary ball launching device.

The base 102 supports an arm holder 106 disposed on the base 102. The arm holder 106 holds and pivotally supports a thrower arm 108. The thrower arm 108 is configured to launch a ball 12 and is spring biased in a pivoting direction. The thrower arm 108 has a first end 108*a* and a second end 108*b*. A ball cradle 110 is disposed on, or connected to, the first end 108*a* of the thrower arm 108. In some examples, as shown in FIGS. 1-3, the second end 108*b* of the thrower arm 108 is releasably attached to the arm holder 106. In other examples, as shown in FIGS. 4-6, the second end 108*b* of the thrower arm 108 is pivotally supported to the arm holder 106 about a first axis of rotation $R_X$ via an axle 218, wherein the thrower arm 108 may move upward or downward about the pivot point at the first axis of rotation $R_X$. The arm holder 106 may include a ramped surface 206, as shown in FIG. 4, limiting movement of the thrower arm 108 in a downward direction L when the thrower arm 108 pivots in a counterclockwise direction CW about the first axis of rotation $R_X$. The ball cradle 110 may be any shape (e.g., square, round, triangle) capable of receiving a ball 12 and holding the ball 12 in the ball cradle 110 until the ball 12 is launched. The ball cradle 110 holds the ball 12 during the movement of the thrower arm 108 in a downward direction L (explained below).

In some implementations, a thrower stop 112 limits the pivotal movement of the thrower arm 108 to a ball releasing position of the thrower arm 108, which defines the launch point LP of a ball 12 from the ball cradle 110. In some implementations, as shown in FIGS. 1-3, the thrower stop 112 is disposed between the arm holder 106 and the thrower arm 108. Referring to FIGS. 4-6, in some implementations, a spring support 214 is disposed on the second end 108*b* of the thrower arm 108 and the thrower stop 112 is disposed between the base 102 and the spring support 214. In the examples shown, a first end 214*a* of the spring support 214 is disposed on the second end 108*b* of the thrower arm 108, and the thrower stop 112 is disposed between a second end 214*b* of the spring support 214 and the base 102. In some implementations, the thrower stop 112 telescopes between a retracted position and an expanded position about the vertical axis Z defined by the base 102.

In some implementations, as shown in FIGS. 1-3, a spring tower 114 is disposed on the base 102 and defines an opening 116 allowing the thrower arm 108 to pass therethrough. The spring tower 114 includes a top portion 114*a* and a bottom portion 114*b*. In some examples, one or more spring locators 117 are disposed on the top portion 114*a* of the spring tower 114. The spring locators 117 connect a spring 118 between the spring tower 114 and the thrower arm 108. One or more spring locators 117 may also be disposed on the thrower arm 108 to connect to the spring 118 (a.k.a. thrower arm spring). In some examples, the spring tower 114 includes spring locators 117 in its top portion 114*a* (as shown), allowing one or more springs 118 to bias the thrower arm 108 upwards. The thrower arm 108 moves within the opening 116 of the spring tower 114 as it is biased upwards.

Referring to FIGS. 4-6, in some implementations, the spring tower 114 is omitted and the springs 118 are connected between the spring support 214 and the thrower stop 112 or base 102. In some examples, one or more spring locators 117 are disposed proximate to the second end 214*b* of the spring support 214 and connect the spring 118 between the spring support 214 and the thrower stop 112 or the base 102. One or more spring locators 117 may also be disposed on the thrower stop 112 or the base 102. In some examples, the spring support 214 includes spring locators 117 adjacent to its second end 214*b* (as shown), allowing one or more springs 118 to bias the thrower arm 108 upwards. The thrower arm 108 pivots about the first axis of rotation $R_X$ between the thrower stop 112 and the ramped surface 206 of the arm holder 106.

As shown in FIGS. 1-6, the ball launcher 100 includes a loader stand 120 disposed on the base 102 for supporting a support arm 122 having a front portion 122*a*, a middle portion 122*b*, and an end portion 122*c*. In some examples, as shown in FIGS. 4-6, a loader support 220 disposed on the base 102 additionally supports an end of the support arm associated with the front portion 122*a*. The front portion 122*a* includes a ball loader 130. The ball loader 130 includes at least one ball receptacle 132 sized to receive a ball 12 from a first location (e.g., a ball feeder or manually by a user 10) and drop the ball 12 into the ball cradle 110. The perimeter edge of the ball receptacle 132 may include a radius that assist in guiding the ball 12 to the ball receptacle 132 when the ball 12 is received from the first location. In some examples (as shown in FIGS. 4-6), the ball cradle 110 includes one or more ramping features 110*a* that guide the ball 12 into the ball cradle 110 when the ball 12 is dropped from the ball receptacle 132 of the ball loader 130. Additionally or alternatively (as shown in FIGS. 4-6), one or more ball stops 110*b* may be disposed on the ball cradle 110, the ball stops 110*b* stopping the ball 12 from rolling out of the ball cradle 110. The ball loader 130 shown has a cylindrical shape; however, other shapes may also be possible such that the ball loader 130 can rotate and receive a ball 12.

The end portion 122*c* of the support arm 122 includes a motor 140. The motor 140 may be a stepper motor or a servo motor. A stepper motor is a brushless DC electric motor that divides a full rotation into a number of equal steps. The motor can move and hold a position at one of the steps without any feedback sensor (i.e., without providing any feedback to its position); while a servo motor is a rotary actuator that allows for the precise control of angular position, velocity, and acceleration. The servo motor includes a motor that is coupled to a sensor for position feedback and a controller. The middle portion 122*b* includes a shaft 150 (e.g., rotating shaft) connecting the ball loader 130 to the motor 140. Thus, a front end 150*a* of the shaft 150 connects to the ball loader 130 and a back end 150*b* of the shaft 150 connects to the motor 140. In some examples, as shown in FIGS. 4-6, the front end 150*a* of the shaft 150 is rotatably supported by the loader support 220 and the ball loader 130 is disposed on, and therefore coupled to, the shaft 150 for common rotation; however, the ball loader 130 may be rotatably supported by the loader support 220 and coupled to the front end 150*a* of the shaft 150 for common rotation. In an active state, the motor 140 rotates about a second axis of rotation $R_Y$ defined by the shaft 150 that extends from the front portion 122*a* through the middle portion 122*b* to the end portion 122*c* of the support arm 122. The rotation of the motor 140 causes the shaft 150 and therefore the ball loader 130 to rotate in the same direction about the second axis of rotation $R_Y$. In some examples, the ball loader 130 and the shaft 150 rotate in a clockwise direction CW if the thrower arm 108 is positioned on the right side of the support arm 122 (as shown in the figures). The ball loader 130 and the shaft 150 may rotate in a counterclockwise if the thrower arm 108 is positioned to the left of the support arm 122. As described, the ball launcher 100 includes a motor 140; however in some implementations, the ball launcher 100 includes a manual rotator 142, which as shown is disposed on ball loader 130; however, the manual rotator 142 may be disposed on the end portion 122*c* of the support arm 122. The manual rotator 142 allows a user 10 to manually rotate the support arm 122 causing the release of the ball 12 from the ball receptacle 132 and causing a loader arm 160 to engage with the thrower arm 108 when the loader arm 160 contacts a contact surface 208 associated with the thrower arm 108. In some examples, the motor 140 may be initiated by a foot pedal or a wind-up crank.

The loader arm 160 is disposed on the support arm 122. In some examples, the loader arm 160 is releasably connected to the shaft 150 for common rotation about the second axis of rotation $R_Y$ when the shaft 150 rotates. In some examples, the loader arm 160 has a variable position about the shaft 150 along the second rotating axis $R_Y$. The shaft 150 may include a keyway slot for securing the loader arm 160 to the shaft 150 and preventing the loader arm 160 from disengaging from the shaft 150. The keyway holder may be releasably connected to the shaft 150 for tightening the engagement between the shaft 150 and the loader arm 160. A user 10 may untighten the keyway holder to move/translate the loader arm 160 about the shaft 150. The loader arm 160 may move/translate along the second rotating axis $R_Y$ to a position on the shaft 150 desired by the user 10 for securing the loader arm 160 to the shaft 150. The variable position of the loader arm 160 provided by moving the loader arm 160 about the shaft 150 alters a contact point 908 (FIG. 9) between the loader arm 160 and the contact surface 208 associated with the thrower arm 108 (discussed below), which in turn affects a height $H_{ball}$ that the ball 12 is launched from. In some implementations, the loader arm 160 moves about the shaft 150 when a user 10 rotates the manual rotator 142.

In some examples, the loader arm 160 is releasably connected to the ball loader 130. The loader arm 160 may include a connector 162 to secure the loader arm 160 to the ball loader 130. As shown, in FIG. 2, the loader arm 160 includes first and second connectors 162*a*, 162*b*. Moreover, and as shown, the loader arm 160 is substantially in contact with the ball loader 130. In some examples, the connectors 162 are adjustable, allowing the ball loader 130 to be separated a threshold distance from the loader arm 160. Adjusting the position of the loader arm 160 about the shaft 150 or from the ball loader 130 is another method a user 10 may consider to adjust the launch point LP of the ball 12 from the ball cradle 110.

The loader arm 160 defines a longitudinal axis $X_{arm}$ substantially perpendicular to the second axis of rotation $R_Y$ and has a length $L_{arm}$ along its longitudinal axis $X_{arm}$ that extends and reaches the contact surface 208 associated with the thrower arm 108. When the loader arm 160 is connected (e.g., secured) to the shaft 150 (or ball loader), the loader arm 160 rotates in unison with the shaft 150 and the ball loader 130 about the second axis of rotation $R_Y$. The loader arm 160 is a mechanical linkage transforming rotary motion from the loader arm 160 about the second axis of rotation $R_Y$ into linear motion by the thrower arm 108 in the downward direction L (about the first axis of rotation $R_X$). For instance, the loader arm 160 engages the thrower arm 108 when the loader arm 160 contacts the contact surface 208, by applying a force in the downward L direction as the loader arm 160 rotates. Therefore, the length $L_{arm}$ of the loader arm 160 is at least capable of reaching the contact surface 208 so that the loader arm 160 reaches and pushes the thrower arm 108 downwards as it rotates. Moreover, a greater length of the loader arm $L_{arm}$ allows for a longer engagement time between the loader arm 160 and the thrower arm 108 when the loader arm 160 contacts the contact surface 208, causing the loader arm 160 to push the thrower arm 108 a greater distance in the downward direction L.

In some examples, the loader arm 160 is rotatably supported about the second axis of rotation $R_Y$ and extends away from the axis of rotation R. The loader arm 160 may extend perpendicular to the second axis of rotation $R_Y$ of the ball loader 130 or at any other angle. As shown in FIGS. 1-3, the loader arm 160 may have a rectangular shape with the top and bottom portions of the rectangular shape being a square or a rectangular shape; however, the loader arm 160 may have a cylindrical shape. In some examples, the loader arm 160 has a tip attached thereon. The tip may be a round tip for reducing the friction between the loader arm 160 and the contact surface 208 associated with the thrower arm 108 during the engagement phase. As shown in FIGS. 1-3, the contact surface 208 corresponds to a top surface of the thrower arm 108.

Referring to FIGS. 4-6, in some implementations, the ball launcher 100 includes an engagement member 228 disposed on the top surface of the thrower arm 108. The engagement member 228 may support the contact surface 208 at a height $H_{CS}$ above the thrower arm 108. The contact surface 208 may be rounded to reduce friction when the loader arm 160 contacts the contract surface 208 and/or to assist in disengaging the loader arm 160 from the contact surface 208 during a disengagement phase. In some examples, the contract surface 208 is a roller rotatably supported by the engagement member 228 about a third axis of rotation $R_{YZ}$. When the loader arm 160 contacts the roller 208 as the loader arm 160 rotates about the second axis of rotation $R_Y$, the loader arm 160 causes the roller 208 to rotate as the loader arm 160 applies the force in the downward L direction to the thrower arm 108.

In some examples, the contact surface 208 supported by the engagement member 228 is angled with respect to a longitudinal axis $Y_{TA}$ defined by the thrower arm 108. Angling the contract surface 208 allows a height of the contract surface 208 above the thrower arm 108 to be variable between a first height $H_{CS_a}$ and a lower second height $H_{CS_2}$. Accordingly, the contact point 908 between the loader arm 160 and the contact surface 208 may be altered to occur at any height between $H_{CS_a}$ and $H_{CS_b}$ of the contact surface 208, which in turn affects a height $H_{ball}$ that the ball 12 is launched from. As discussed above, moving the loader arm 160 about the shaft 150 alters the contract point between the loader arm 160 and the contact surface 208. Additionally or alternatively, the engagement member 228 disposed on the thrower arm 108 may move along the longitudinal axis $Y_{TA}$ of the thrower arm 108, For example, the thrower arm 108 may include a keyway slot for securing the engagement member 228 to the thrower arm 108 and preventing the engagement member 228 from disengaging from the thrower arm 108. The keyway holder may be releasably connected to the thrower arm 108 for tightening the engagement between the thrower arm 108 and the engagement member 228. The user 10 may untighten the keyway holder to move/translate the engagement member 228 about the thrower arm 108. The engagement member 228 may move/translate about the thrower arm 108 to secure the engagement member 228 to the thrower arm 108 at a position desired by the user 10. The movement of the engagement member 228 about the thrower arm 108 alters the contact point 908 between the loader arm 160 and the contact surface 208 to occur at any height between $H_{CS_a}$ and $H_{CS_b}$ of the contact surface 208, which in turn affects a height $H_{ball}$ that the ball 12 is launched from. For example, the duration of contract between the loader arm 160 and the contact surface 208 increases as the contract point approaches the first height $H_{CS_a}$ on the contact surface 208. Thus, increasing the duration of contact between the loader arm 160 and the contact surface 208 results in the magnitude of force applied to the thrower arm 108 in the downward direction L about the pivot point at the first axis of rotation $R_X$ to be increased. In some implementations, the loader arm 160 moves about the shaft 150 when a user 10 rotates the manual rotator 142.

In some implementations, as shown in FIGS. 4 and 5, the loader arm 160 has a lobe shape and includes a ramped engagement surface 260 and a nose portion 262 for contacting the contact surface 208 associated with the thrower arm 108 as the loader arm 160 rotates about the second axis of rotation $R_Y$. The nose portion 262 is centered about the longitudinal axis $X_{arm}$ of the loader arm 160 and the ramped engagement surface 260 extends from the nose portion 262 at an angle respective to the longitudinal axis $X_{arm}$. When the loader arm 160 engages the thrower arm 108, the contact point 908 between the loader arm 160 and the contract surface 208 traverses along the ramped engagement surface 260 to the nose portion 262 as the loader arm 160 rotates about the second axis of rotation $R_Y$. The ramped engagement surface 260 allows the loader arm 160 to smoothly push the thrower arm 108 in the downward direction L about the pivot point at the first axis of rotation $R_X$. In some examples, the angle of the ramped engagement surface 260 with respect to the longitudinal axis $X_{arm}$ of the loader arm 160 is selected to achieve a desired timing from when the loader arm 160 initially engages the thrower arm 108 to when the loader arm 160 disengages from the thrower arm 108, thereby causing the thrower arm 108 to bias in an opposite upward direction to launch and release the ball 12 from the ball cradle 110 and into the environment.

Referring to FIGS. 1-6, the ball loader 130 and the loader arm 160 are arranged so that when the ball loader 130 rotates, it causes the ball receptacle 132 to release a received ball 12 into the ball cradle 110. In some examples, once the ball loader 130 releases the received ball 12 from the ball receptacle 132 into the ball cradle 110, the loader arm 160 engages and moves the thrower arm 108 from a first biased position (e.g., a released state) and an engaged position. The first biased position refers to a ball receiving or releasing position, wherein the ball receiving position is associated with receiving the ball 12 from the ball receptacle 132 into the ball cradle 110 and the ball releasing position is associated with launching the received ball 12 from the ball cradle 110 to environment subsequent to the engaged position after the loader arm 160 disengages from the thrower arm 108. In other examples, the ball loader 130 releases the received ball 12 from the ball receptacle 132 into the ball cradle 110 after the loader arm 160 engages the thrower arm 108, but before the loader arm 160 moves the thrower arm 108 from its ball receiving position (e.g., first biased position) to its engaged position. As shown, a loader arm 160 is positioned on an opposite end of the ball receptacle 132 (i.e., the loader arm 160 extends away from the ball receptacle 132).

Figure 7:
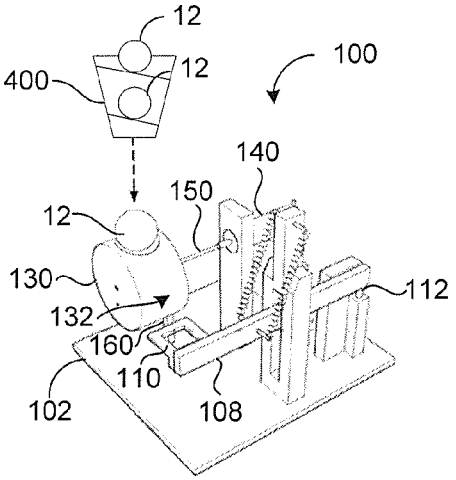
FIG. 7 is a schematic view of an exemplary ball launching device as a ball loader receives a ball.

Referring to FIGS. 7-10B, operations for launching a ball 12 to the environment are shown. While FIGS. 7-10B are described with reference to the arrangement of the ball launcher 100 shown in FIGS. 1-3, the operations are equally applicable to the arrangement of the ball launcher 100 shown in FIGS. 4-6. In some examples, a user 10 or a ball feeder 400 feeds the ball receptacle 132 of the ball loader 130 a ball 12 in a ball receiving position as shown in FIG. 7. In the example shown, the ball feeder 400 is a frustoconical shape and includes a helical ramp around the circumferential surface for feeding one or more balls 12 to the to the ball receptacle 132 in the ball receiving position. In other examples, the ball feeder 400 is a hopper for holding one or more balls 12 and feeding one ball 12 at a time to the ball receptacle 132 in the ball receiving position. The hopper may have a frustoconical shape or any other shape for facilitating balls to be fed to the ball receptacle 132. In some examples, the thrower arm 108 defines a longitudinal axis $Y_{TA}$. The longitudinal axis $Y_{TA}$ of the thrower arm 108 is substantially parallel to the fore-aft axis Y of the base 102 when the thrower arm 108 is in the ball receiving position. The ball receiving position allows the ball receptacle 132 to receive the ball 12. When the thrower arm 108 is spring biased and the ball cradle 110 is not supporting a ball 12, the thrower arm 108 is in a first biased position, biased upwards (FIG. 7) due to the springs 118 that are preventing the thrower arm 108 from moving in a downward direction L. When the ball cradle 110 receives and is supporting the ball 12, the thrower arm 108 is in a second biased state (FIG. 8) due to the additional weight of the ball 12; the springs 118 maintain the thrower arm 108 in this second biased position despite the weight of the ball 12 that is applying a downward force in the downward direction L. The motor 140 (e.g., manual or automatic) rotates the ball loader 130 causing the ball 12 to drop on the ball cradle 110 of the thrower arm 108.

Figure 8:
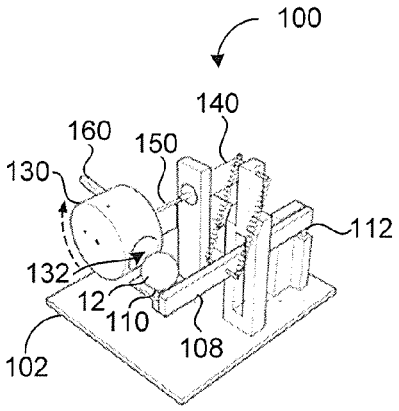
FIG. 8 is a schematic view of the exemplary ball launching device of FIG. 7 as a ball cradle receives the ball from the ball loader.
Figure 9:
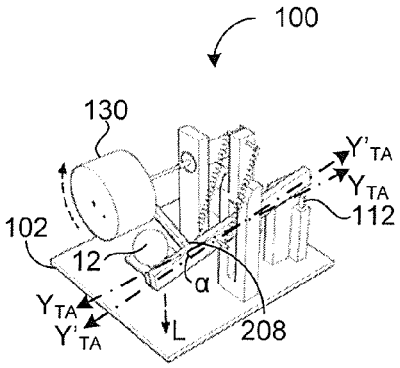
FIG. 9 is a schematic view of the exemplary ball launching device of FIG. 7 as a thrower arm pulls downwards before releasing the ball.

FIG. 8 shows the ball receptacle 132 releasing the ball 12 to the ball cradle 110. The ball receptacle 132 is positioned at a height from the base 102 greater than the height H of the ball cradle 110 from the base 102 allowing the ball 12 to roll out of the ball receptacle 132 by gravitational force. The support arm 122 continues to rotate after the ball receptacle 132 drops the ball 12 in the ball cradle 110 causing the loader arm 160 to contact the contract surface 208 associated with the thrower arm 108, and thereby engage with the thrower arm 108. The engagement of the loader arm 160 and the thrower arm 108 causes the thrower arm 108 to move between its second biased position (FIG. 8) to a third biased position or an engaged position (FIG. 9). The engagement between the loader arm 160 and the thrower arm 108 causes the loader arm 160 to push the thrower arm 108 in a downward direction L about a pivot point towards the base 102 until the rotation of the support arm 122 prevents the loader arm 160 from reaching the thrower arm 108. Referring to FIGS. 4-6, in some implementations, the loader arm 160 pushes the thrower arm 108 in the downward direction L about the first axis of rotation $R_X$ at the pivot point provided by the axle 218 rotatably supporting the second end 108*b* of the thrower arm 108 to the arm holder 106.

FIG. 9 shows the second end 108*b* of the thrower arm 108 shifting away from the thrower stop 112 as the thrower arm 108 moves in the downward direction L about the pivot point. The longitudinal axis $Y_{TA}$ of the thrower arm 108 shifts to a transposed longitudinal axis $Y'_{TA}$ having an angle $\alpha$ there between when the loader arm 160 applies force to the thrower arm 108 in the downward direction L. When the loader arm 160 disengages from the thrower arm 108, the thrower arm 108 transitions between its third biased state to a released state (e.g., ball releasing position (FIG. 10A)). The released state corresponds to the first biased position. During the released state, the thrower arm 108 moves in a direction opposite the downward direction L, i.e., in an upward direction about the pivot point, to reach a ball release point LP of the thrower arm 108. During the ball release position, the thrower arm 108 launches the ball 12 to the environment. Moreover, during the ball release position, the thrower stop 112 controls the angle $\alpha$ that the ball 12 may be released at. The ball release position is set by the thrower stop 112; therefore, the height H from the base 102 at which the ball 12 is released and the ball release point LP is determined by the thrower stop 112, since the thrower stop 112 limits the movement of the thrower arm 108. In some examples, the ball 12 is launched from the ball cradle 110 towards the external environment and may reach a height of 20 feet or more. When the longitudinal axis $Y_{TA}$ of the thrower arm 108 returns to its substantially parallel position to the fore-aft axis Y of the base 102 at the ball release position, the ball 12 is released at a substantially straight angle with respect to the base X-Y plane. However, any adjustment to the thrower stop 112 modifies the ball release point LP of the ball 12. In other examples, when the legs 104 are adjusted resulting in an angled base 102 with respect to the surface plane $X_G$-$Y_G$, then the ball cradle 110 releases the ball 12 at a 90 degree angle with respect to the base 102, which is at an angle from the $X_G$-$Y_G$ surface plane.

Figure 10A:
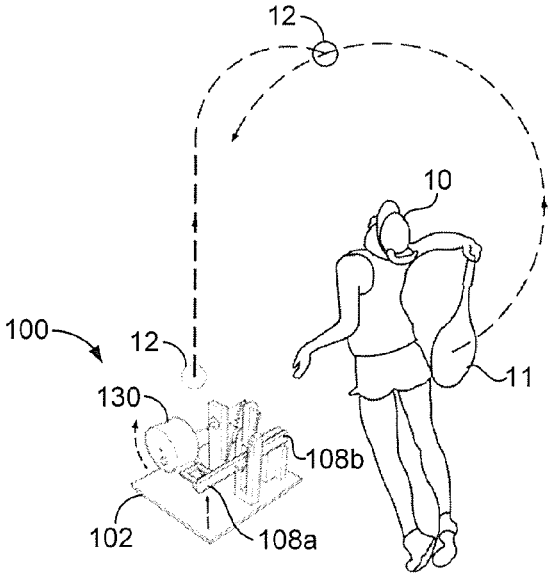
FIGS. 10A and 10B are schematic views of the exemplary ball launching device of FIG. 7 as the thrower arm launches the ball.

FIG. 10A shows a user 10 waiting to hit the ball 12 with a racquet 11 as the ball 12 is launched to the environment. FIG. 7B shows the user 10 hitting the ball 12 with the racquet 11 after the ball 12 is launched in the environment and then bounces off the ground. Therefore, the user 10 may hit the ball 12 as the ball 12 is being launched into the environment or at any subsequent time.

Figure 10B:
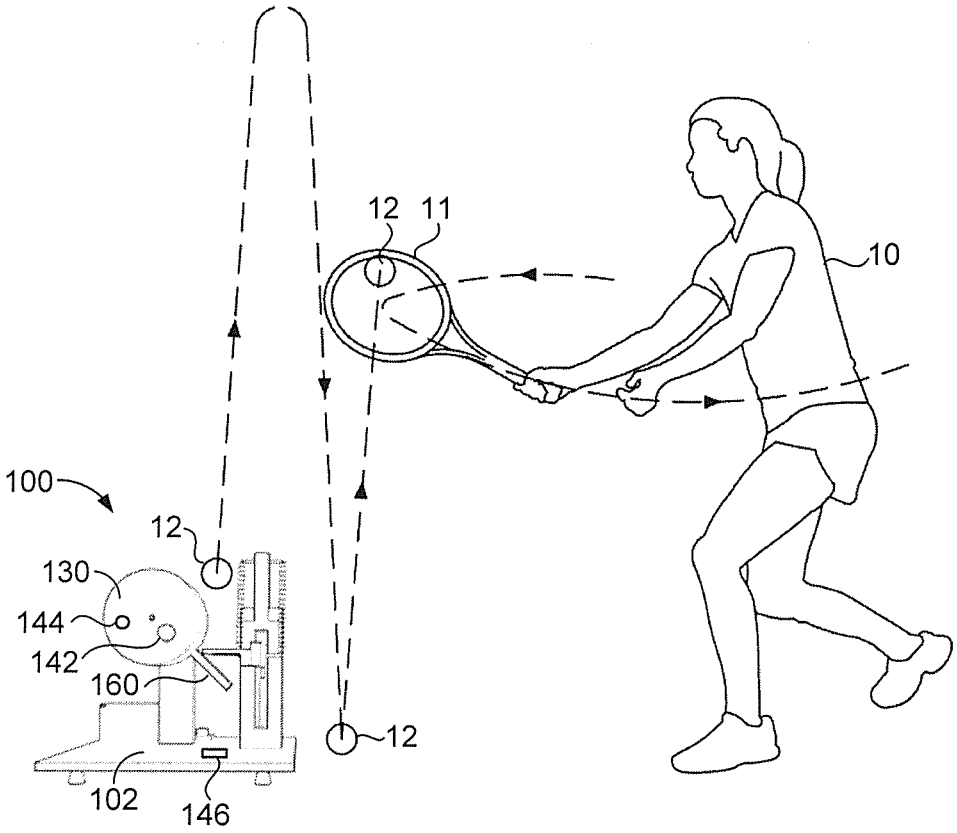

In some examples, the manual rotator 142 may be used as a visual reference point allowing the user 10 to know the ball launcher 100 will launch the ball 12. Additionally or alternatively, a light indicator 144 may be disposed on the ball loader 130 (as shown in FIG. 10B) or at any location on the ball launcher 100 that is visible to the user 10. The light indicator 144 may flash on and off or change color when the ball launcher 100 is getting ready to launch the ball 12. In some examples, the ball launcher 100 includes a speaker 146 (FIG. 10B) that produces a sound alerting the user 10 that the ball launcher 100 is getting ready to launch the ball 12. The sound may change as the ball launcher 100 gets closer to releasing the ball 12.

In some examples, the ball launcher 100 includes a power button 170 supported by the base 102 for activating or de-activating the ball launcher 100. A rheostat 172 is supported by the base 102 and allows a user 10 to control the frequency of the number of balls 12 launched by the thrower arm 108. The rheostat 172 is an adjustable resistor that changes the resistance in an electric circuit. The rheostat 172 is in electrical communication with the motor 140 and controls the speed of the motor 140, which in turn controls the frequency that the ball loader 130 releases a ball 12 in the ball cradle 110 and the loader arm 160 engages the ball launcher 100. The rheostat 172 has resistance elements that can be metal wire or ribbon, carbon, or a conducting liquid. The rheostat 172 is a two-terminal variable resistor; however, a three-terminal potentiometer may be used having one unconnected terminal if the application is a low-power application.

In some implementations, a user 10 may adjust the height H of the ball cradle 110 from the base 102. A height controller (not shown) supported by the thrower arm 108 or the spring tower 114 controls the height H of the launching ball cradle 110 from the base 102. Therefore, a user 10 may increase the height H of the ball cradle 110 and thus increase the distance and time of engagement between the loader arm 160 and the thrower arm 108. The user 10 may decrease the height H of the ball cradle 110 from the base 102, thus decreasing the engagement time and travel distance between the thrower arm 108 and the loader arm 160. In addition, the position of the loader arm 160 on the shaft 150 may also affect the engagement duration and travel distance between the thrower arm 108 and the loader arm 160; the closer the loading arm is to the ball loader 130, the greater the engagement time is because the distance that the loader arm 160 pushes in the downward direction L is also greater. The greater the distance and duration of engagement, the loader arm 160 applies more force causing the ball 12 to launch at a faster speed. The height controller may be a thumbscrew or any other screw that allows a user 10 to adjust it by loosening or tightening the screw by hand. The height controller may control the height of the arm holder 106 or the spring tower 114 or both.

Referring to FIGS. 1-6, the loader arm 160 is shown to be positioned behind the ball loader 130 on the shaft 150, extending at opposite ends from the ball receptacle 132 about the second axis of rotation $R_Y$; however, different structures may also be possible. For example, the ball loader 130 may define more than one ball receptacle 132, and the loader arm 160 may include multiple loader arms 160, each arm positioned between two ball receptacles 132. When the ball cradle 110 receives a ball 12, the loader arm 160 engages the thrower arm 108. This increases the rate at which the thrower arm 108 can launch balls 12.

In some implementations, not shown, the ball loader 130 is positioned on the front portion 122*b* of the support arm 122. The motor 140 is positioned on either the front portion 122*a* or the end portion 122*c*, and the loader arm 160 is positioned on either the first portion 122*a* or the end portion 122*c*, different than the motor 140. In such examples, the ball loader 130 is arranged such that when a ball 12 is released from the ball receptacle 132, the ball 12 is released in the ball cradle 110 of the thrower arm 108. In addition, the loader arm 160 is configured to engage the thrower arm 108.

In some implementations, the motor 140 is positioned in the middle portion 122*b* of the support arm 122 and the ball loader 130 and the loader arm 160 is each positioned on either the front portion 122*a* or the end portion 122*c* of the support arm 122. Therefore, the ball loader 130 may be positioned on the support arm 122 where the ball receptacle 132 is capable of delivering a ball 12 to the ball cradle 110 of the thrower arm 108.

In some examples, the ball launcher 100 includes a power source 180 supported by the base 102 for powering the electrical components (e.g., the motor 140) of the ball launcher 100. The power source 180 may be in electrical communication with the power button, the motor 140, and the rheostat 172 and delivers power to these components, as necessary. The power source 180 may be a battery or a direct current power supply that connects to a wall outlet.

In some examples, a cover (not shown) is disposed over the ball launcher 100. The cover may be configured to lock with the base 102. The cover includes several apertures for receiving a ball 12 at the ball receptacle 132 of the ball loader 130 and another aperture for releasing the ball 12 from the ball cradle 110 of the thrower arm 108. The cover may include a handle allowing a user 10 to easily carry the ball launcher 100 from a first location to a second location. The power button 170 and the rheostat 172 are protruding out of the cover allowing a user 10 the capability to activate or deactivate the ball launcher 100 or to change the frequency of the ball release. In some examples, the ball launcher 100 is controlled by a remote control, such that a user 10 can turn the ball launcher 100 on or off, adjust the frequency of the thrower arm 108, adjust the thrower stop 112, and/or adjust the distance $D_L$ of each leg 104 from the ground surface 14. The cover may be attached to the base 102 by one or more methods including but not limited to bolting, threading, welding, or frictional engagement. These methods may also be used to secure other parts of the ball launcher 100 together. In some examples, a bolt and a nut are used secure the parts to one another or to the base 102.

The ball launcher 100 helps a user 10 build muscle memory because the user 10 can configure the ball launcher 100 to his/her preferred settings and repeatedly hit the ball 12. Muscle memory is a form of procedural memory that involves consolidating a specific motor task into memory through repetition of that motor task. Therefore, the ball launcher 100 launches a ball 12 repetitively at the same height, at the same speed, and at the same angle with every repetition, which over time causes a long-term muscle memory to be created for that task, eventually allowing the player 10 to perform that task without conscious effort. Therefore, the ball launcher 100 builds the muscle memory of a player 10, allowing the player 10 to improve his/her serve.

Figure 11:
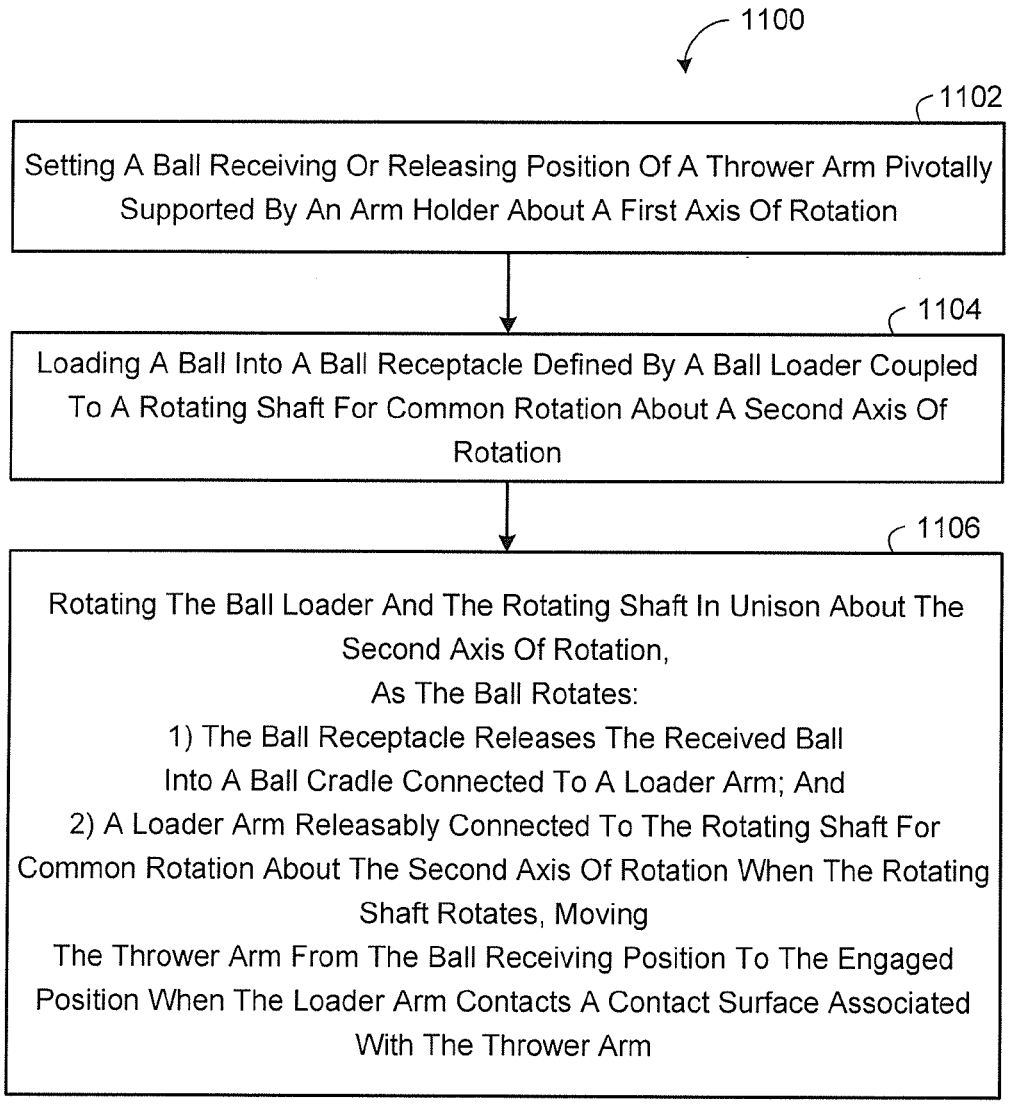
FIG. 11 is a schematic view of an exemplary arrangement of operating a ball launching device.

Referring to FIG. 11, a method 1100 for launching a ball is described with reference to FIGS. 1-10B. The method includes setting 1102 a ball receiving or releasing position of a thrower arm 108 pivotally supported by an arm holder 106 about a first axis of rotation $R_X$. The thrower arm 108 may be spring biased about the first axis of rotation $R_X$ between the ball receiving or releasing position and an engaged position. The method further includes loading 1104 a ball 12 into a ball receptacle 132 defined by a ball loader 130 coupled to a rotating shaft 150 for common rotation about a second axis of rotation $R_Y$ defined by the rotating shaft 150 when the rotating shaft 150 rotates, the second axis of rotation $R_Y$ substantially perpendicular to the first axis of rotation $R_Y$. The method also includes rotating 1106 the ball loader 130 and the rotating shaft 150 in unison about the second axis of rotation $R_Y$. As the ball loader rotates, the ball receptacle 132 releasing the received ball 12 from the ball receptacle 132 into a ball cradle 110 connected to the thrower arm, and a loader arm 160 moving the thrower arm 108 from the ball receiving position to the engaged position when the loader arm 160 contacts a contract surface 208 associated with the thrower arm. The loader arm 160 is releasably connected to the rotating shaft 150 for common rotation about the second axis of rotation $R_Y$ when the rotating shaft 150 rotates. The loader arm 160 defines a longitudinal axis $X_{arm}$ substantially perpendicular to the second axis of rotation $R_Y$ of the rotating shaft 150.

Figure 12:
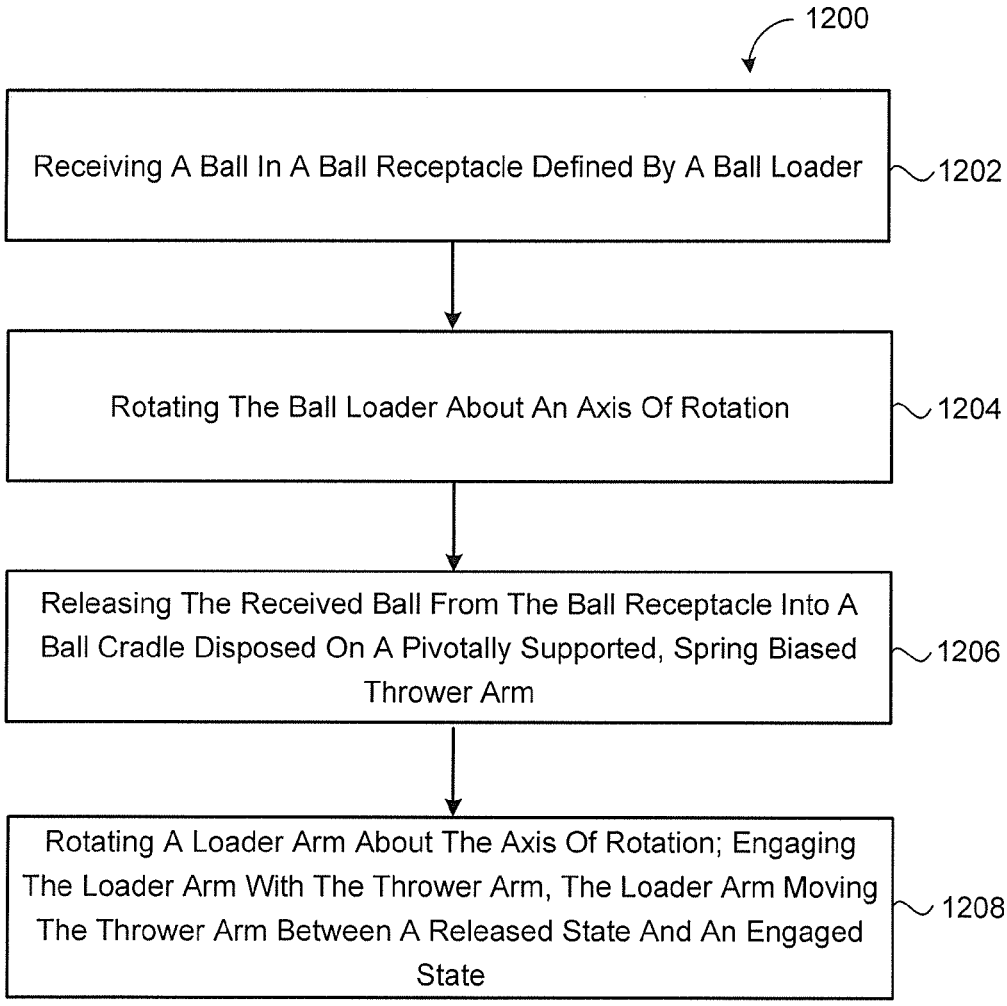
FIG. 12 is a schematic view of an exemplary arrangement of operating a ball launching device.

Referring to FIG. 12, in some implementations, a method 1200 of launching a ball 12 includes receiving 1202 a ball 12 in a ball receptacle 132 defined by a ball loader 130, rotating 1204 the ball loader 130 about an axis of rotation $R_Y$, and releasing 1206 the received ball 12 from the ball receptacle 132 into a ball cradle 110 disposed on a pivotally supported spring biased thrower arm 108. The method 1200 also includes rotating 1208 a loader arm 160 about the axis of rotation $R_Y$ and engaging the loader arm 160 with the thrower arm 108. The loader arm 160 moves the thrower arm 108 between a ball receiving or releasing position (where the ball cradle 110 is not supporting a ball 12) and an engaged state (where the loader arm 160 is engaged with the thrower arm 108).

Referring back to FIGS. 1-12, the method 1100, 1200 may further include releasing the received ball 12 from the ball receptacle 132 into the ball cradle 110 before the loader arm 160 engages the thrower arm 108. The method 800, 900 may also include releasing the received ball 12 from the ball receptacle 132 into the ball cradle 110 after the loader arm 160 engages the thrower arm 108 and before the loader arm 160 moves the thrower arm 108 from its ball receiving position to its engaged position.

The loader arm 160 may extend perpendicular to the axis of rotation $R_Y$. The loader arm 160 may define more than one ball receptacle 132. In some examples, the method 1100, 1200 includes adjusting a length $L_{arm}$ of the loader arm 160 to alter an angular pivot range of the thrower arm 108 about the first axis of rotation $R_X$ while engaged by the loader arm 160.

The method 1100, 1200 may also include adjusting a position of the loader arm 160 about the rotating shaft 150 along the second axis of rotation $R_Y$ to alter an angular pivot range of the thrower arm 108 while engaged by the loader arm 160. The method 1100, 1200 may include limiting pivotal movement of the thrower arm 108 to set the ball releasing position of the thrower arm 108 having a ball launching point LP. Additionally or alternatively, the method 1100, 1200 may include adjusting a thrower stop 112 arranged to limit pivotal movement of one end of the thrower arm 108. The thrower arm 108 having a first end 108*a* connected to the ball cradle 110 and a second end 108*b* rotatably supported by the arm holder about the first axis of rotation $R_X$.

A number of implementations have been described. Nevertheless, it will be understood that various modifications may be made without departing from the spirit and scope of the disclosure. Accordingly, other implementations are within the scope of the following claims.

What is claimed is:

1. A ball launcher comprising:

a horizontal base;

a thrower arm mounted to an arm holder which is mounted to the horizontal base;

the thrower arm spring biased and pivotal about a transverse axis between a ball receiving or releasing position and an engaged position;

a rotating shaft mounted along an axis perpendicular to the transverse axis, wherein the rotating shaft includes a ball loader for dispensing a ball onto the thrower arm; and a loader arm, wherein, a ball is dispensed to the thrower arm and then the loader arm contacts the thrower arm, pushing against the spring bias, then releases the thrower arm to pivot upward and launch the ball.

2. The ball launcher of claim 1, wherein the ball loader releases the received ball from a ball receptacle into a ball cradle before the loader arm engages the thrower arm.

3. The ball launcher of claim 1, wherein the ball loader releases the received ball from a ball receptacle into a ball cradle after the loader arm engages the thrower arm and before the loader arm moves the thrower arm from its ball receiving position to its engaged position.

4. The ball launcher of claim 1, wherein the loader arm has a variable length.

5. The ball launcher of claim 1, wherein the loader arm has a variable position about the rotating shaft along the axis perpendicular to the transverse axis.

6. The ball launcher of claim 1, wherein a contact surface associated with the thrower arm comprises a top surface of the thrower arm.

7. The ball launcher of claim 1, wherein a contact surface associated with the thrower arm is supported by an engagement member disposed on the thrower arm, the thrower arm defining a longitudinal axis substantially parallel to the fore-aft axis when the thrower arm is in the ball receiving or releasing position.

8. The ball launcher of claim 7, wherein the contact surface comprises a roller rotatably supported by the engagement member.

9. The ball launcher of claim 7, wherein the contact surface is angled with respect to the longitudinal axis of the thrower arm.

10. The ball launcher of claim 7, wherein the engagement member has a variable position about the thrower arm along the longitudinal axis of the thrower arm.

11. The ball launcher of claim 7, wherein a contact point between the loader arm and the contact surface has a variable height from the thrower arm with respect to the center vertical axis of the horizontal base based upon a position of the engagement member about the thrower arm along the longitudinal axis of the thrower arm and a position of the loader arm about the rotating shaft along the axis perpendicular to the transverse axis.

12. The ball launcher of claim 1, further comprising:

a motor coupled to a back end of the rotating shaft for common rotation about the axis perpendicular to the transverse axis when the motor rotates.

13. The ball launcher of claim 1, further comprising a thrower stop arranged to limit pivotal movement of the thrower arm to set the ball receiving or releasing position of the thrower arm.

14. The ball launcher of claim 1, further comprising:

a spring support disposed on a second end of the thrower arm;

a thrower stop disposed between the spring support and the horizontal base, the thrower stop limiting pivotal movement of the thrower arm about the first axis of rotation to set the ball receiving or releasing position of the thrower arm; and one or more springs connecting the spring support to one of the thrower stop or the horizontal base, the springs biasing the thrower arm in the ball receiving or releasing position when the loader arm and the thrower arm are disengaged and a ball cradle is unoccupied.

15. The ball launcher of claim 14, wherein the thrower stop telescopes between a retracted position and an expanded position to set the ball receiving or releasing position of the thrower arm.

16. The ball launcher of claim 1, further comprising one or more legs supporting the horizontal base, each leg having an adjustable length to tilt the horizontal base with respect to a supporting surface.

17. A method of launching a ball comprising:

providing a thrower arm including a thrower arm spring pivotally supported by an arm holder that is mounted to a horizontal base , wherein the thrower arm spring is biased and pivotal about a transverse axis between a ball receiving or releasing position and an engaged position;

mounting a rotating shaft along an axis perpendicular to the transverse axis, wherein the rotating shaft includes a ball loader for dispensing a ball onto the thrower arm, wherein as the rotating shaft rotates, the ball is dispensed to the thrower arm and then a loader arm contacts the thrower arm, pushing against the spring bias, then releases the thrower arm to pivot upward and launch the ball.

18. The method of claim 17, wherein a ball receptacle releases the received ball from the ball receptacle into the cradle before the loader arm engages the thrower arm.

19. The method of claim 17, wherein a ball receptacle releases the received ball from the ball receptacle into the ball cradle after the loader arm engages the thrower arm and before the loader arm moves the thrower arm from its ball receiving position to its engaged position.

20. The method of claim 17, further comprising adjusting a length of the loader arm to alter an angular pivot range of the thrower arm about the transverse axis while engaged by the loader arm.

21. The method of claim 17, further comprising adjusting a position of the loader arm about the rotating shaft along the axis perpendicular to the transverse axis to alter an angular pivot range of the thrower arm while engaged by the loader arm.

22. The method of claim 17, further comprising limiting pivotal movement of the thrower arm to set the ball receiving or releasing position of the thrower arm.

23. The method of claim 17, further comprising adjusting a thrower stop arranged to limit pivotal movement of the thrower arm, the thrower arm having a first end connected to the ball cradle and a second end rotatably supported by the arm holder about the transverse axis.

24. The method of claim 23, further comprising connecting one or more springs between a spring support disposed on the second end of the thrower arm and one of the thrower stop or the horizontal base, the springs biasing the thrower arm in the ball receiving or releasing position when the loader arm and the thrower arm are disengaged and the ball cradle is unoccupied.

* * * * *